United States Patent [19]

Troxell, Jr.

[11] Patent Number: 4,537,250

[45] Date of Patent: Aug. 27, 1985

[54] SHEARING TYPE BLOWOUT PREVENTER

[75] Inventor: John N. Troxell, Jr., Houston, Tex.

[73] Assignee: Cameron Iron Works, Inc., Houston, Tex.

[21] Appl. No.: 560,941

[22] Filed: Dec. 14, 1983

[51] Int. Cl.[3] ..... E21B 29/08

[52] U.S. Cl. ..... 166/55; 83/636; 30/92; 72/326

[58] Field of Search ..... 166/55; 251/1 R, 1 A; 83/54, 636; 30/92; 72/325, 326

[56] References Cited

U.S. PATENT DOCUMENTS

| | | | |
|---|---|---|---|
| 3,040,611 | 6/1962 | Tournaire | 83/694 |
| 3,716,068 | 2/1973 | Addison | 166/55 X |
| 3,766,979 | 10/1973 | Petrick | 166/55 |
| 3,863,667 | 2/1975 | Ward | 166/55 X |
| 4,132,265 | 1/1979 | Williams, Jr. | 166/55 |
| 4,215,749 | 8/1980 | Dare et al. | 166/55 X |
| 4,313,496 | 2/1982 | Childs et al. | 166/55 |
| 4,347,898 | 9/1982 | Jones | 166/55 |

FOREIGN PATENT DOCUMENTS

| | | | |
|---|---|---|---|
| 56-3128 | 1/1981 | Japan | 30/92 |

*Primary Examiner*—James A. Leppink
*Assistant Examiner*—Hoang C. Dang
*Attorney, Agent, or Firm*—Vinson & Elkins

[57] ABSTRACT

A ram-type shearing apparatus for a wellhead having a body with a vertical bore therethrough and aligned, opposed ram guideways extending outward in the body from the bore, a ram assembly in each of the guideways, each of the ram assemblies having a ram body with a shearing blade on the face of the ram and means for moving the ram inward and outward in the guideway, the cutting edge of the upper shear blade and the face of the ram assembly below the upper shear blade being concave to support the string during shearing sufficiently to constrain the string below the upper shear blade as it is sheared to a shape suitable for receiving an overshot type of retrieving tool and to allow flow therein, the lower shear blade having at least one node extending toward the upper shear blade so that when a pipe is being sheared the node engages and penetrates the pipe prior to other shearing of the pipe to thereby reduce the force used for such shearing.

3 Claims, 7 Drawing Figures

SHEARING TYPE BLOWOUT PREVENTER

BACKGROUND

It has been common practice to incorporate a shearing type of blowout preventer in a blowout preventer stack so that in the event of a problem the shear rams may be closed and in closing shear a string extending through the stack. Also when used on a production string the shear rams shear the production tubing and seal above the sheared tubing so that pressure is not allowed to escape through the production tubing. When a production string was sheared by these prior art devices the upper end of the lower part of the sheared string is flattened so that it is difficult or impossible to pump fluids into the string bore to kill the well and also is difficult to connect an overshot retrieving tool thereto.

U.S. Pat. No. 4,313,496 discloses a shearing type of blowout preventer which is adapted to shear through drill collars of a drill string and is provided with arms secured to the sides of the shear blades which interengage and function to provide a force to resist the forces tending to vertically separate the cutting blades and to fill the space of the guideways outside the vertical bore of the preventer to prevent the forcing of the member being cut into this space.

Examples of other U.S. patents which disclose ram-type blowout preventer which have shear rams are U.S. Pat. Nos. 3,736,982, 3,817,326, 4,132,265, 4,132,266 and 4,132,267, each of which disclose shear rams which engage and shear pipe extending therethrough and crush the upper end of the fish substantially flat after it is sheared and shearing is accomplished with the use of a very substantial amount of force. Also, U.S. Pat. No. 3,863,667 discloses a combination double pipe shearing and plug device mounted on a partially cut pipe line so that a section of the pipe can be removed and then closed with the plug. The cutting edges are pointed but must cut the pipe without deforming it in order to maintain the seal between the housing and the pipe.

SUMMARY

The present invention relates to an improved shearing type of blowout preventer having shear rams which are so shaped that they do not flatten a production string when it is sheared. The improved blowout preventer includes a body having a vertical bore therethrough with opposed, aligned ram guideways extending outwardly from said bores, a shear ram assembly in each of said guideways and having means for moving the ram assemblies inwardly into the bore and outwardly into the guideways, one of said shear ram assemblies having a lower blade profile including piercing means, such as two nodes or points with the space between the nodes being sufficient to accommodate the thickness of the pipe walls together with a solid bar inside the pipe and the other ram assembly having an upper shear blade with a recess below the blade to constrain the sheared end of the pipe so that the extreme ends of the pipe are bent back to maintain a nominal clearance space between the pipe and the diameter of the bore of the preventer body.

An object of the present invention is to provide an improved shearing type of blowout preventer which can be installed on a production well and which will close on a production string and shear such string but allow the upper end of the lower portion of the sheared string to be sufficiently open to receive fluids to kill the well.

Another object of the present invention is to provide an improved shearing type of blowout preventer which shears pipe when its rams are closed thereon but controls the shape of the sheared string so that it may be readily engaged by an overshot type retrieving tool.

A further object of the prevent invention is to provide an improved shearing ram-type blowout preventer having improved shearing of a string extending therethrough to prevent the string from being flattened outward against the bore of the preventer body.

Still another object is to provide an improved shearing ram-type blowout preventer which shears a pipe string extending therethrough with considerably less force than has been used with the prior art devices.

A still further object of the present invention is to provide an improved shearing type of blowout preventer in which the shearing action also shears a string or wire line extending through the interior of the string being sheared.

Still a further object of the present invention is to provide an improved shearing type of blowout preventer which allows larger sized pipe to be sheared therein.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENTS

Figure 1:
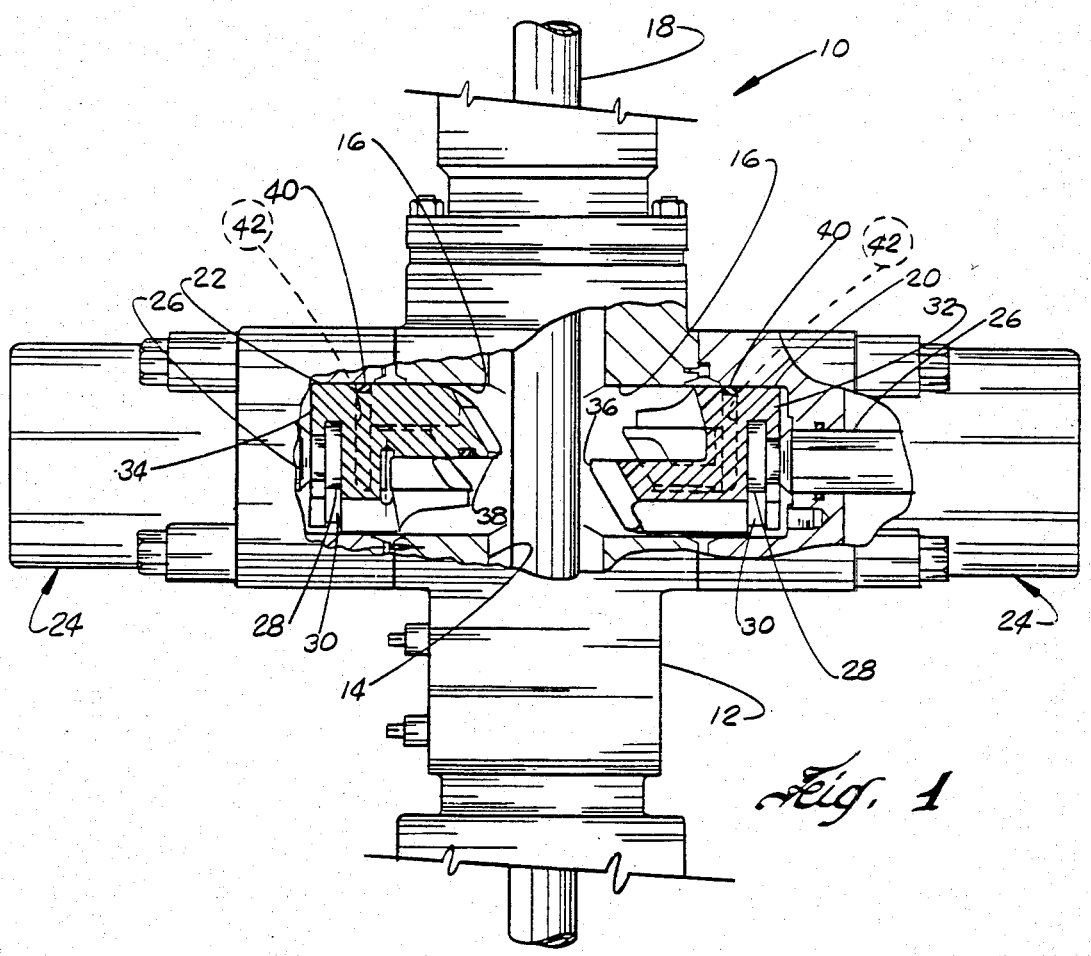
FIG. 1 is an elevation view of the improved blowout preventer of the present invention with portions of the body broken away to illustrate the shear rams in their retracted position.

As shown in the drawings, blowout preventer 10 includes body 12 having a central bore 14 extending vertically therethrough and ram guideways 16 which are aligned and extend outwardly through body 12 from opposite sides of bore 14. In FIG. 1 production tubing string 18 is shown extending through bore 14 in its normal position and with ram assemblies 20 and 22 positioned in their retracted position within guideways 16. Production tubing string 18 is supported below blowout preventer 10 in the normal manner so that when it is sheared it does not drop below the blowout preventer 10. Suitable means 24 is provided for moving ram assemblies 20 and 22 inwardly and outwardly in their respective guideway 16. Such means (not shown in section) includes the usual ram piston which is connected to its ram by connecting rod 26. Flanges 28 on the ends of connecting rod 26 engage in slots 30 in the rear of ram bodies 32 and 34 to provide connection of ram assemblies 20 and 22 from their moving means 24.

Blowout preventer 10 includes shearing means for the cutting of tubing 18, when it is desirable such as when there is a well blowout. The cutting of the tubing provides the means for controlling of a well blowout. Ram assembly 20 shown in the right hand side of the drawings and ram assembly 22 shown in the left hand side of the drawings each include a shear blade. Lower shear blade 36 is integral with (or if hardened blades are desired) is secured to the face of body 32 of ram assembly 22 and upper shear blade 38 is a part of or secured to the face of body 34 of ram assembly 20.

Figure 6:
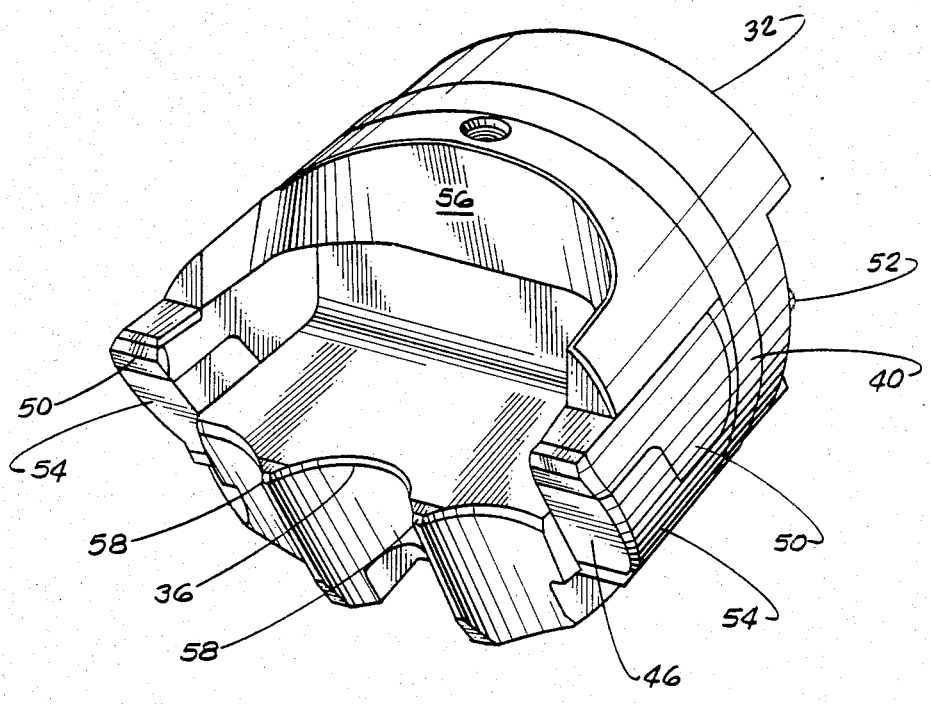
FIG. 6 is a perspective view of the lower shear blade ram assembly.
Figure 7:
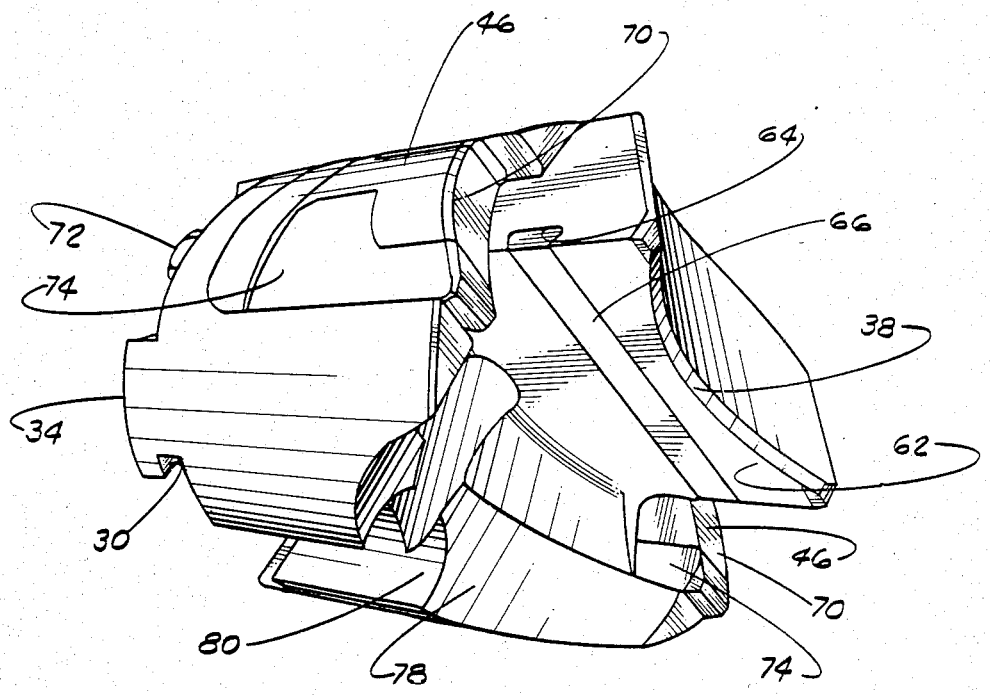
FIG. 7 is a perspective view of the upper shear blade ram assembly.

In addition to the shear blades 36 and 38 each of ram assemblies 20 and 22 include top seals 40 which are positioned in the grooves 42 which extend across the top of ram bodies 32 and 34 from side to side and provide a continuation of side packings 44 and 46 on ram bodies 32 and 34, respectively. Lower shear blade 36 is integral with ram body 32, has a flat upper surface 48 for sealing, as hereinafter explained, and has side packings 44 which are secured to body 32 by a stud (not shown) which is secured to the side metal portion 50 of side packing 44 and extends through body 32 and is secured thereto by nut 52 (FIG. 6). Side packings 44 which are positioned on each side of body 32 are similar but are the reverse image of each other. Side packings 44 each include resilient packing 54 and metal portion 50 which extends forwardly at each side of body 32 above surface 48. Resilient packing 54 extends from a position in engagement with the lower end of top seal 40 forward to a position to coact with and seal with the surface seal 66 which engages surface 48 on body 32. Metal portions 50 of side packings 54 provide rigid side projections at each side of body 32 which coact with recess 56 in the top portion of body 32 to provide a recess to contain the sheared top portion of a string which has been sheared by rams 20 and 22. Lower shear blade 36 includes a shearing edge which functions as a piercing means. Such piercing means includes forward facing nodes 58 which initially engage string 18 as is clearly shown in FIG. 3. By including such piercing means in one of the shear blades, it is believed that the forces necessary for the shearing of a string are reduced over the forces which have been necessary with shear blades of the prior art. Ram body 32 includes lower mud slot 60 which extends along the underside of body 32 to provide a communication to the rear of ram assembly 20 to balance the well pressure exerted on the face of the rams when the rams are closed.

Upper shear blade 38 is integral with ram body 34 and has a concave shape to its face and surface 62 thereunder which is flat and has groove 64 extending completely across surface 62. Packing seal 66 is positioned in groove 64. Side packings 46 are provided on each side of shear blade 38 and are secured to ram body 34 by studs (not shown) which are secured to metal portion 70 of side packing 46 and extend through body 34 with nut 72 threaded on the end of stud to secure side packings 46. Side packings 46 each include metal portion 70 and resilient packing 74 which is in engagement with the side portions of top seal 40. The resilient portions of side packings 44 and 46 coact with top seals 40 and packing seal 66 to provide a complete seal across bore 14 when ram assemblies 20 and 22 are closed. Ram body 34 below shear blade 38 has a concave shape and coacts with side packings 46 to provide concave recess 78 in which the lower portion of string 18 is positioned after shearing. Mud slot 80 extends along the lower portion of ram body 34 to provide communication to the rear of ram body 34. Opening 82 is provided at the central portion of recess 78 to provide a flow passage through which fluids may flow after closing and shearing of string 18 to conduct control fluids to the interior of string 18.

Figure 2:
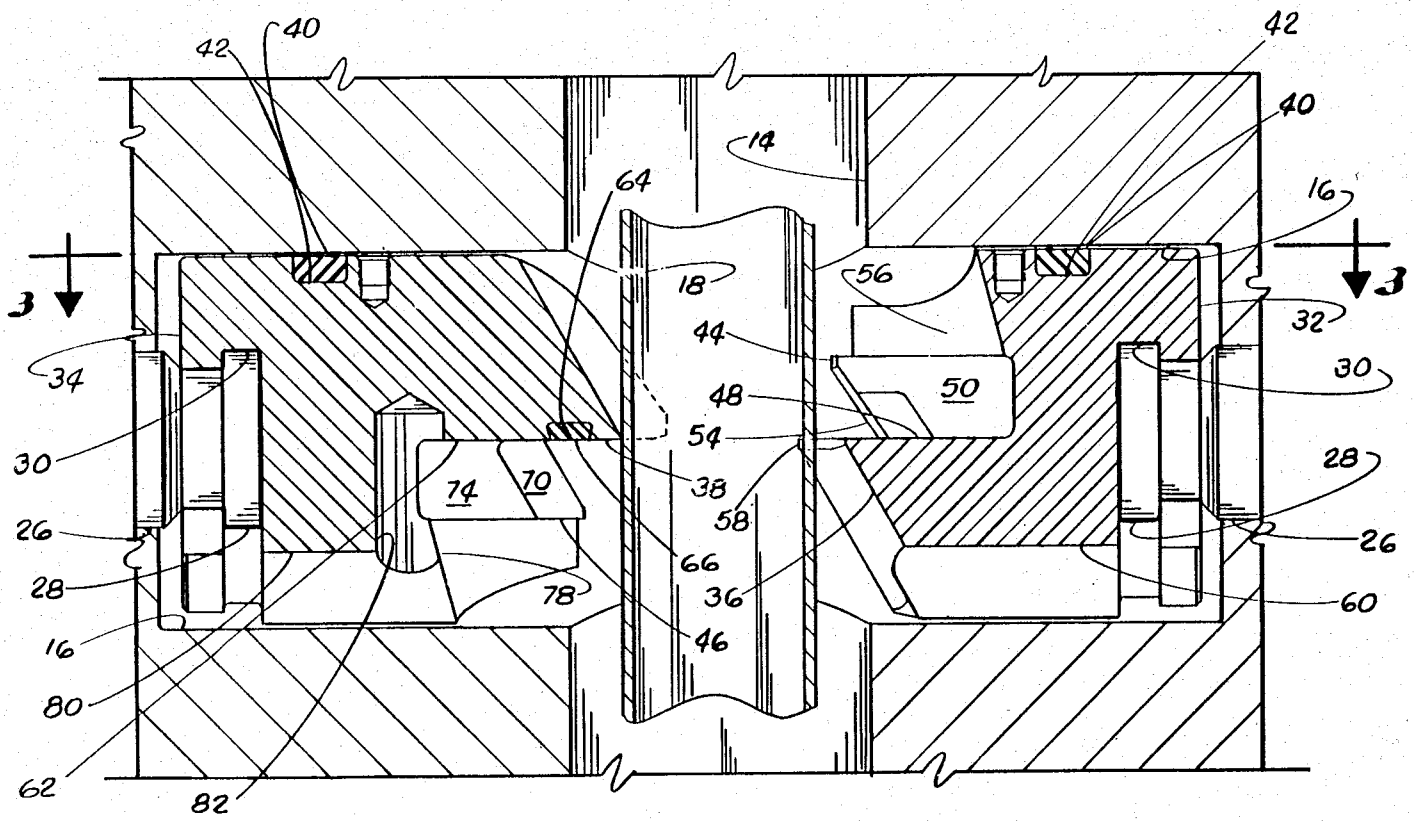
FIG. 2 is a detail sectional view of the shear rams in their extended position in contact with the tubing string extending through the bore of the preventer body.
Figure 3:
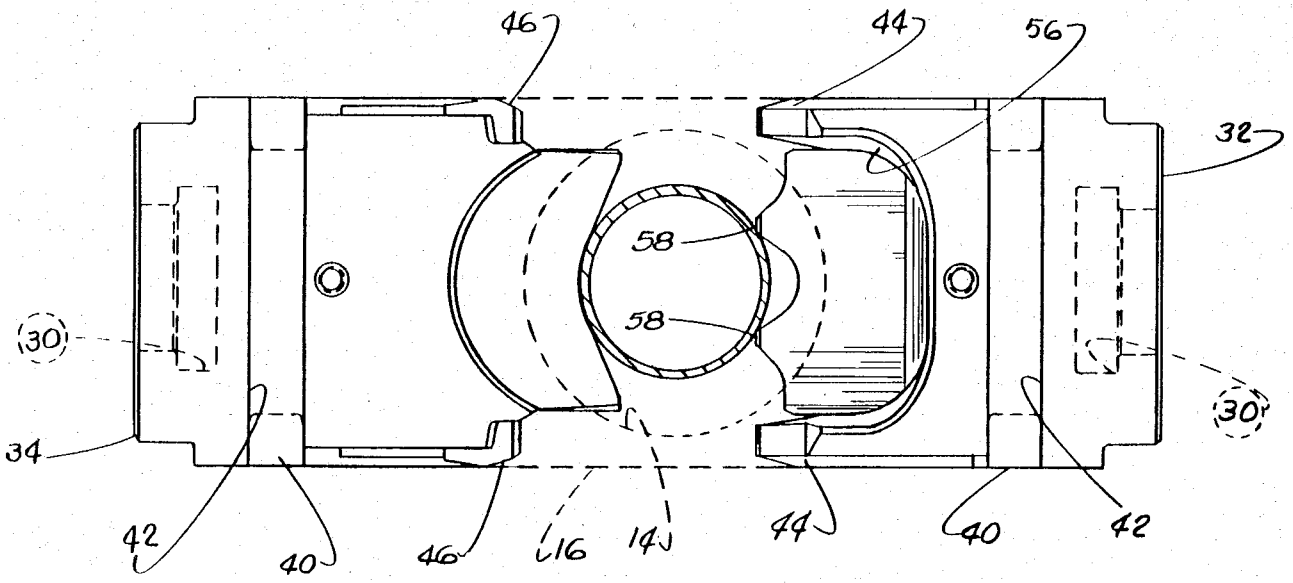
FIG. 3 is a plan view of the shear rams taken along line 3—3 in FIG. 2 with the preventer body omitted for clarity.

As shown in FIGS. 2 and 3 the initial contact with tubing 18 is made by nodes 58 and the other side of tubing 18 is engaged by the concave central forward edge of shear blade 38. It should be noted that shear blade 38 is shaped to center string 18 so that on further movement of the ram assemblies, the shearing is started by a penetration of string 18 by nodes 58. Such initial penetration is believed to be the reason that the improved device of the present invention requires much less force for shearing of a tubing or pipe string that the devices of the prior art.

Figure 4:
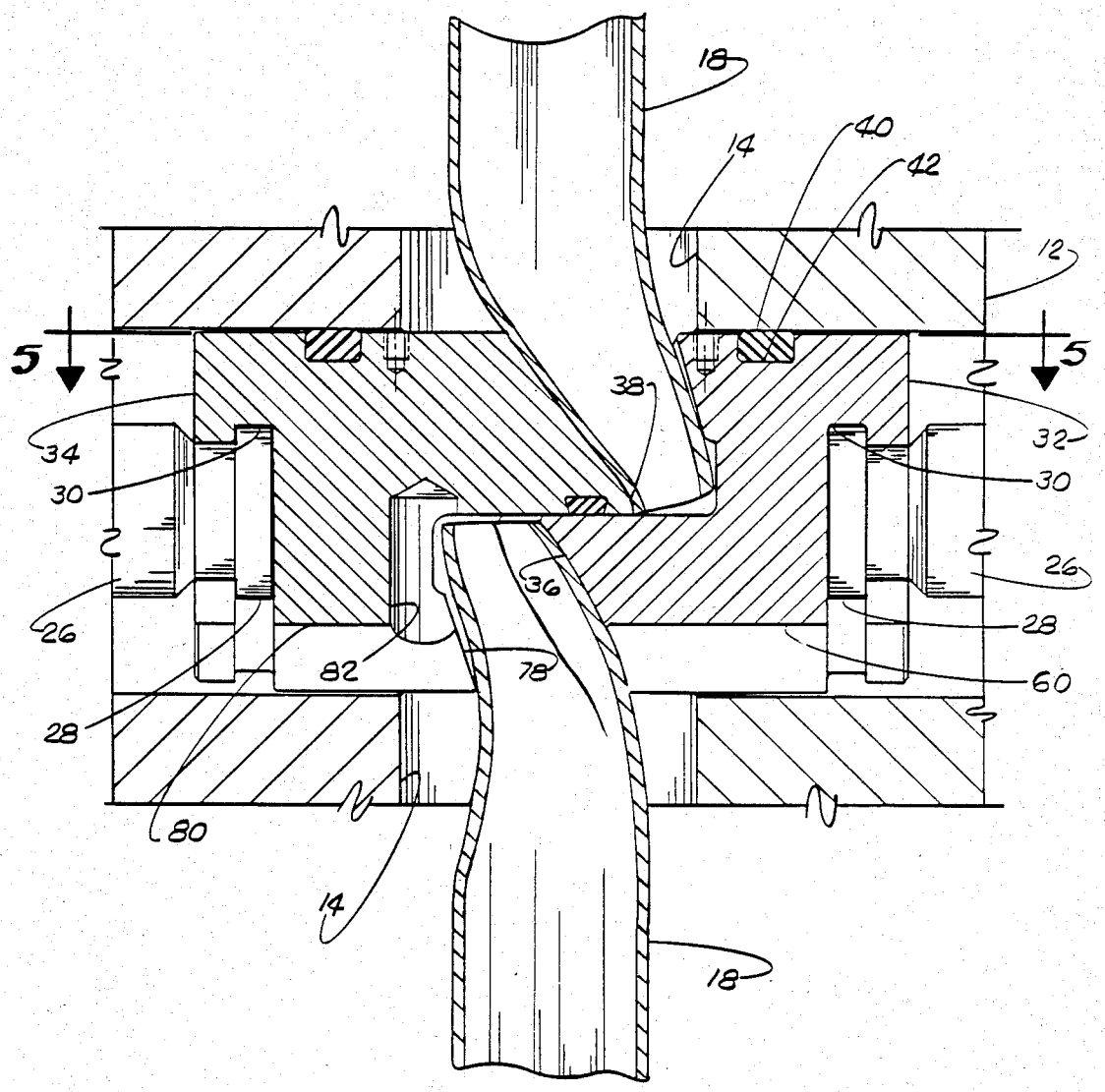
FIG. 4 is another detail sectional view of the shear rams in their extended or sheared position after shearing the tubing string.
Figure 5:
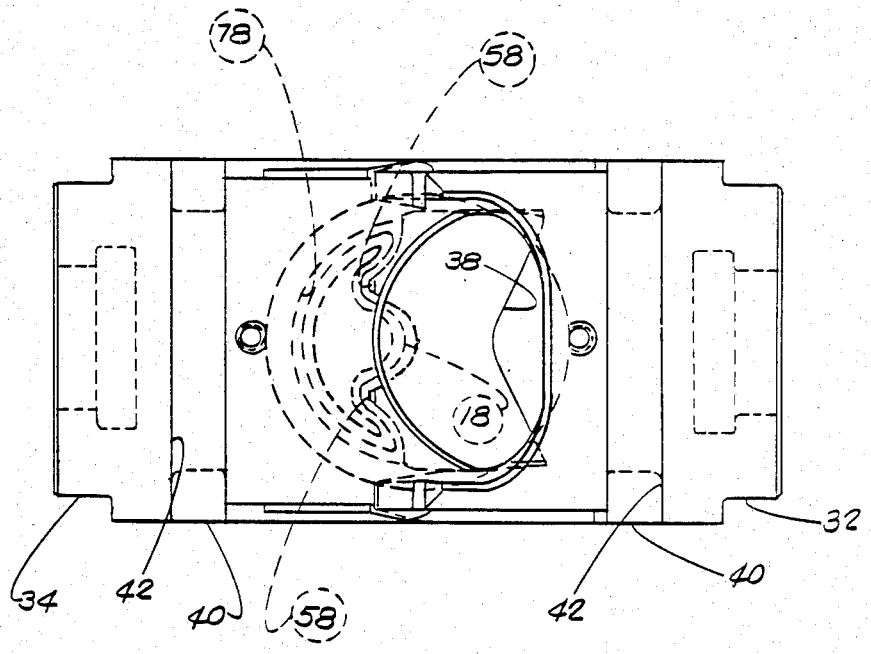
FIG. 5 is a plan view of the shear rams taken along lines 5—5 in FIG. 4 to illustrate other details of the shearing with the preventer body and the upper sheared part of the string omitted for clarity.

As the ram assemblies continue their inward movement, they complete the shearing of tubing 18 and all of the time during the shearing the side of the pipe adjacent upper shear blade 38 is totally supported and when shearing is completed, as shown in FIGS. 4 and 5, the portion of the tubing remaining in the well below upper shear blade 38) is not crushed but remains open at its upper end as shown in FIG. 5. This allows fluids for controlling a well blowout to be introduced into the annulus surrounding tubing 18 below ram assemblies 20 and 22. The well control fluid flows upward in the annulus since it is normally closed by a suitable packer and enters the opening 82 and into the upper end of the string to flow downward to the producing formation.

It should also be noted from FIG. 5 that the shape of the ram assemblies constrain the upper end of the lower sheared string to have a shape that is suitable for engagement by an overshot retrieving tool.

It is believed that the improvement in controlling the sheared shape of the upper portion of the sheared string results from the shape of the shear blades and the recesses formed by the inner faces of the ram bodies and the side packings These configurations provide a support of semicircular shape for the side of string opposite the lower shear blade nodes so that it is not deformed in a manner which would prevent fluid circulation after shearing is complete Also this structure controls the shape of the sheared string to keep it within bore 14 and so that it is easily engaged by a tool after fluid control of the well is attained.

What is claimed is:

1. A ram-type shearing apparatus for a wellhead comprising a body having a bore therethrough and ram guideways extending laterally from opposite sides of the bore, a ram assembly located in each of the ram guideways, each ram assembly comprising a ram body and means for reciprocating the ram bodies into and from the bore, each ram body having a cutting blade in position for the cutting edge of the blade on one ram body to pass just below the cutting edge of the blade on the other to shear a string positioned in the bore when the ram assemblies are moved together in the bore, sealing means on each of said ram bodies including a sealing strip positioned in a groove extending transversely across the lower surface of the upper of said cutting blades to seal against the upper surface of the lower of said cutting blades, the lower cutting blade includes a pair of nodes on its face extending toward the upper cutting blade with an arcuate recess therebetween to engage the string initially during shearing and to penetrate said string prior to other shearing of the string whereby the forces of shearing said string are reduced, the shape of said ram bodies and their cutting blades constraining the upper end of the lower sheared portion of the string so that it is partially open after the lower cutting blade is in sealing engagement with said upper cutting blade sealing strip to allow flow therein to be engaged by an overshot type of retrieving tool.

2. A ram-type shearing apparatus for a wellhead comprising a body having a bore therethrough and ram guideways extending laterally from opposite sides of the bore, a ram assembly comprising a ram body, a ram body located in each of the ram guideways, and means for reciprocating the rams into and from the bore, each ram body having a cutting blade in position for the cutting edge of the blade on one ram body to pass just below the cutting edge of the blade of the other ram body to shear a string position in the bore when the ram assemblies are moved together in the bore, and one of said cutting blades including a pair of spaced apart piercing nodes for initiating the shearing of the string by initially piercing such string.

3. A ram-type shearing apparatus according to claim 2 including means associated with each ram assembly for sealing across said bore when said ram assemblies are closed.

* * * * *